US005316811A

United States Patent [19]

Focke et al.

[11] Patent Number: 5,316,811

[45] Date of Patent: May 31, 1994

[54] PROCESS, WEB OF MATERIAL AND APPARATUS FOR PRODUCING PACKAGING BLANKS

[75] Inventors: Heinz Focke; Kurt Liedtke, both of Verden, Fed. Rep. of Germany

[73] Assignee: Focke & Co (GmbH & Co.), Verden, Fed. Rep. of Germany

[21] Appl. No.: 902,888

[22] Filed: Jun. 23, 1992

Related U.S. Application Data

[62] Division of Ser. No. 427,215, Oct. 24, 1989, which is a division of Ser. No. 184,640, Apr. 21, 1988, Pat. No. 4,898,569.

[30] Foreign Application Priority Data

May 20, 1987 [DE] Fed. Rep. of Germany ..... 3716897

[51] Int. Cl.[5] ..... B65D 65/28

[52] U.S. Cl. ..... 428/43; 206/273; 206/268; 229/146; 229/160.1; 428/134; 428/136; 428/537.5; 493/910; 493/911

[58] Field of Search ..... 428/43, 136, 134, 537.5; 493/910, 911; 229/160.1, 146; 206/273, 268

[56] References Cited

U.S. PATENT DOCUMENTS

| | | | |
|---|---|---|---|
| 761,449 | 5/1904 | Collins | 242/71.9 |
| 780,689 | 1/1905 | Smith | 242/71.9 |
| 802,189 | 10/1905 | Haskins | 242/71.9 |
| 1,236,357 | 8/1917 | Reeve | 242/71.9 |
| 1,289,084 | 12/1918 | Banzett | 493/370 |
| 1,289,084 | 12/1918 | Banzett | 493/370 |
| 2,331,316 | 10/1943 | Freedman | 493/354 |
| 2,659,542 | 11/1953 | Steuber | 242/70 |
| 2,868,473 | 1/1959 | Hoisington | 242/72 |
| 3,521,833 | 7/1970 | Ridgeway et al. | 242/118.61 |
| 3,700,099 | 10/1972 | Heroux | 242/118.61 |
| 3,834,639 | 9/1974 | Barber | 242/68 |
| 4,101,095 | 7/1978 | Carter | 242/71.9 |
| 4,117,988 | 10/1978 | Moore | 242/71.9 |
| 4,251,022 | 2/1981 | Focke | 229/160.1 |
| 4,597,748 | 12/1986 | Wolf | 493/413 |
| 4,654,878 | 3/1987 | Lems . | |
| 4,688,708 | 8/1987 | Irvine et al. | 493/410 |
| 4,753,384 | 6/1988 | Focke | 229/160.1 |
| 4,843,798 | 7/1989 | Fozke | 493/411 |

FOREIGN PATENT DOCUMENTS

| | | |
|---|---|---|
| 187323 | 7/1986 | European Pat. Off. . |
| 421009 | 4/1924 | Fed. Rep. of Germany . |
| 470357 | 4/1925 | Fed. Rep. of Germany . |
| 647889 | 9/1934 | Fed. Rep. of Germany . |
| 1106683 | 5/1961 | Fed. Rep. of Germany . |
| 1926159 | 10/1965 | Fed. Rep. of Germany . |
| 1802706 | 12/1971 | Fed. Rep. of Germany . |
| 2646421 | 4/1978 | Fed. Rep. of Germany . |
| 2119456 | 5/1978 | Fed. Rep. of Germany . |
| 2300635 | 8/1983 | Fed. Rep. of Germany . |
| 1540616 | 9/1968 | France . |
| 210845 | 11/1940 | Switzerland . |

*Primary Examiner*—Ellis P. Robinson
*Assistant Examiner*—Nasser Ahmad
*Attorney, Agent, or Firm*—Sughrue, Mion, Zinn, Macpeak & Seas

[57] ABSTRACT

In the production of packs, especially hinge-lid packs, from rigid packaging material (thin cardboard), hitherto individual blanks have been supplied in stacks and introduced into the packaging machine in succession. To make the handling of the blanks easier and to increase the storage capacity, the blanks (23) are now connected to one another via residual connections (25) into a continuous web of material (24) wound as a reel (30). Within the packaging machine, the blanks are severed from the web of material (23) in succession, specifically as a result of the elimination of the residual connections, preferably by being torn off. The residual connections (25) are formed in a region of the blanks (23) or in the region of folding tabs of the latter which, in the finished pack (hinge-lid pack), are concealed by other folding tabs, that is to say are on the inside.

1 Claim, 5 Drawing Sheets

PROCESS, WEB OF MATERIAL AND APPARATUS FOR PRODUCING PACKAGING BLANKS

This is a divisional of application Ser. No. 07/427,215, filed Oct. 24, 1989, now abandoned which is a divisional application of Ser. No. 07/184,640, filed Apr. 21, 1988 (now U.S. Pat. No. 4,898,569).

BACKGROUND OF THE INVENTION

The invention relates to a process for producing packaging blanks and for delivering them to a packaging machine, especially for the manufacture of hinge-lid packs from (thin) cardboard or the like, the blanks being formed as a result of the punching of packaging material.

In the production of packs from thin packaging material, such as paper, the packaging material is supplied to the packaging machine as a wound web of material (reel). In the packaging machine, the web of material is drawn off from the reel and divided by means of severing knives into blanks which are then folded to form the pack.

When packaging material of higher rigidity is concerned, for example in packs made of cardboard, blanks are prefabricated at the factory by being punched from sheets of material (sheet stock), delivered in stacks and introduced in this form into the packaging machine. This is equipped with a blank-magazine for receiving the stacked blanks and for the extraction of these in succession. Particularly packaging machines for producing hinge-lid packs to receive cigarettes, etc. operate in this way.

The prefabrication of the blanks in separate production shops and the transport and handling of the stack of blanks is complicated and involves a high outlay. Furthermore, for reasons of space, the receiving capactiy of a blank-magazine of a packaging machine for stacks of blanks is limited.

SUMMARY OF THE INVENTION

Starting from this, the object on which the invention is based is to improve the production of blanks and the delivery of these to the packaging machine or to folding units of the latter, especially to make it easier to supply packaging machines with blanks consisting of relatively thick or relatively strong packaging material (cardboard).

To achieve this object, it is proposed, according to the invention, that the blanks be severed from a continuous web of material of the width of at least one blank, in such a way that the blanks, with the exception of residual connections, are initially punched during the production of the web of material and are separated during use, especially within the packaging machine, by being torn off from the web of material.

The invention is based on the knowledge that it is not possible to produce complete blanks of (thin) cardboard within the packaging machine by means of punching. Consequently, pre-punching of the blanks takes place in the region of the previous production shops, especially in cardboard-manufacturing factories. However, the blanks are delivered joined together via residual connections and are supplied to the packaging machine in this form. The individual blanks are then formed in the region of the latter by being torn off.

According to the invention, the blanks prepared in this way are no longer produced from sheet stock, but are delivered as a continuous web of material wound and therefore forming a reel. This is introduced into the packaging machine. The web of material is drawn off. The blanks are then produced from this in succession by being torn off.

According to a further important feature of the invention, the residual connection between the blanks which is to be eliminated within the packaging machine is arranged in such a way that the edges of folding tabs freed thereby lie concealed within the (ready-folded) pack. This means that the irregular edges formed when the blanks are torn off or severed are not visible on the finished pack.

The feeding of partially prefabricated, but still interconnected blanks of cardboard or the like allows storage and presentation in the form of a wound roll (reel) of a relatively large diameter, for example 80 cm. This ensures, in the region of the packaging machine, a considerable reserve which, depending on the performance of the packaging machine, is sufficient for approximately one hour of uninterrupted production of the packaging machine. The reel is appropriately wound on a drum which is equipped with lateral drum flanges for protecting the pre-punched blanks. According to the invention, the diameter of the drum flanges is larger than the diameter of the reel, so that the filled drum can be handled and transported by being rolled on the drum flanges.

Further features of the invention relate to the design of the blanks, of the web of material and of the drum for receiving the reel. Exemplary embodiments of the design of the blanks and of the web of material and of the apparatus are explained in detail below with reference to the drawings. In these:

DETAILED DESCRIPTION OF THE PREFERRED EMBODIMENT

Figure 1:
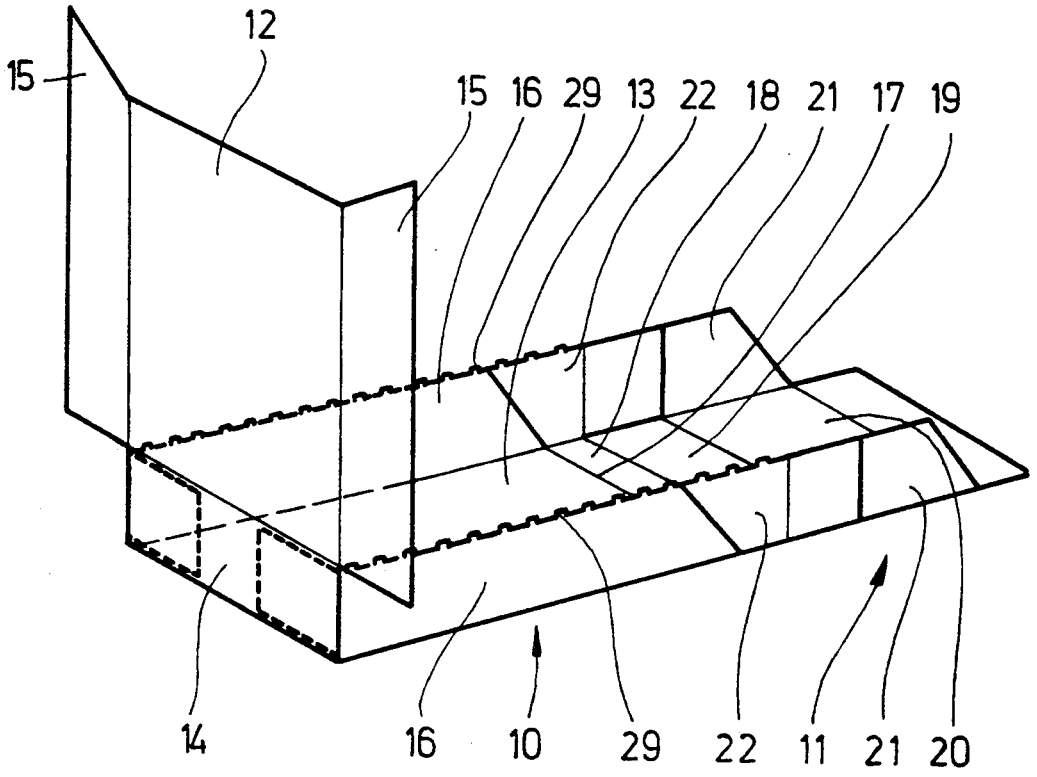
FIG. 1 shows a perspective representation of a partially folded pack of the hinge-lid type.

The exemplary embodiments illustrated in the drawings relate to cuboid hinge-lid packs for cigarettes. Such a hinge-lid pack made of thin cardboard conventionally consists of a box part 10 and of a hinge lid 11. The box part 10 comprises a front wall 12, an opposite rear wall 13, a bottom wall 14 connecting these to one another, and (narrow) side walls which are formed from outer side tabs 15 resting on top of one another, that is to say overlapping one another, and corresponding inner side tabs 16 of approximately the same width. The outer side tabs 15 are connected by means of the front wall 12 and the inner side tabs 16 are connected by means of the rear wall 13. In the ready-folded hinge-lid pack, the above-mentioned side tabs 15, 16 rest against one another with a complete overlap and are joined together by means of adhesive bonding.

The hinge lid 11, which, in this particular case, is likewise folded only partially, is connected to the box part 10 and to the rear wall 13 of the latter via a transversely directed flap hinge 17. This adjoins a lid rear wall 18, a lid top wall 19 and a lid front wall 20.

In the hinge lid 11 too, side walls are formed from lid side tabs lying on top of one another and glued together, specifically from outer lid side tabs 21 connected to the lid front wall 20 and inner lid side tabs 22 connected to the lid rear wall 18.

The pack (hinge-lid pack) formed in this way is produced from a blank 23 which has pre-embossed folding lines for limiting the pack walls and folding tabs described.

In the present exemplary embodiment, the blanks 23 are connected to one another into a continuous web (24) of packaging material. The web of material 24 (FIG. 2) consists of blanks 23, the longitudinal extension of which is directed transversely and which are pre-punched and pre-embossed. The blanks 23 lying next to one another are connected together only in part regions of the edges butting against one another, specifically via residual connections 25 which occur at a distance from one another as a result of short punched portions 26. Outside the region of these residual connections 25, the blanks 23 are separated from one another as a result of continuous punching cuts 27 and 28. The blanks 23 are held together by means of the residual connections 25 to form a continuous web of material 24, the width of which corresponds to the length of the blanks 23. The edge contours of the web of material 24 correspond to the form of the blanks in the end regions.

The residual connections 25 are formed in the region of blank parts which, in the finished hinge-lid pack, are on the inside or concealed. In the exemplary embodiment illustrated, the adjacent blanks 23 are connected to one another in the region of the inner side tabs 16 and of the likewise inner lid side tabs 22, that is to say in a middle region of the web of material 24.

For the processing of the blanks 23, these are severed, in particular torn off, in succession from the web of material 24. The resulting free edges 29 of the side tabs 16 and of the lid side tabs 22 have an irregular, serrated form (FIG. 1). As described, in the finished pack these edges 29 are overlapped by the outer side tabs 15 and lid side tabs 21 and are invisible from outside.

Figure 2:
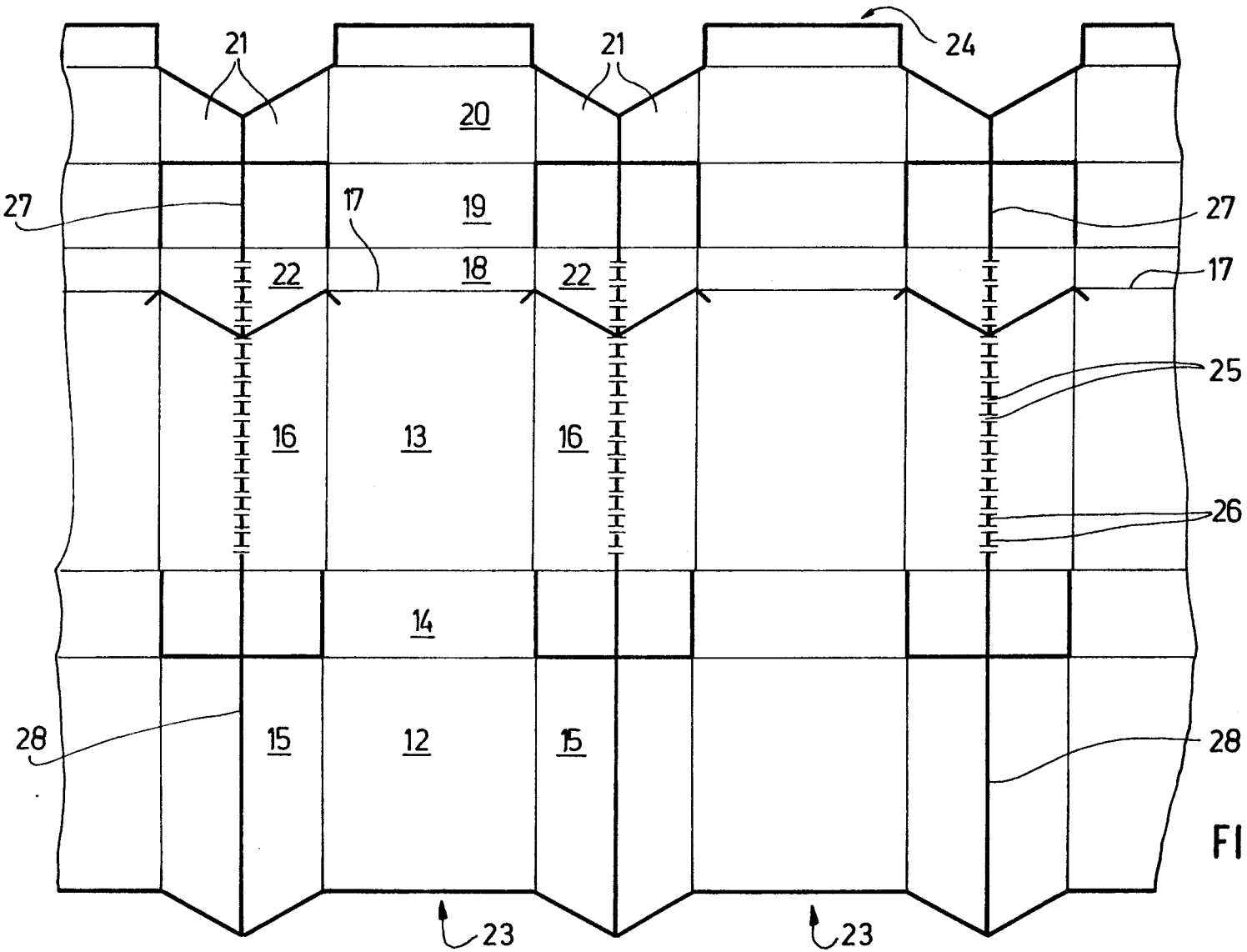
FIG. 2 shows, on an enlarged scale, a portion of a web of material consisting of blanks for a pack according to FIG. 1.
Figure 3:
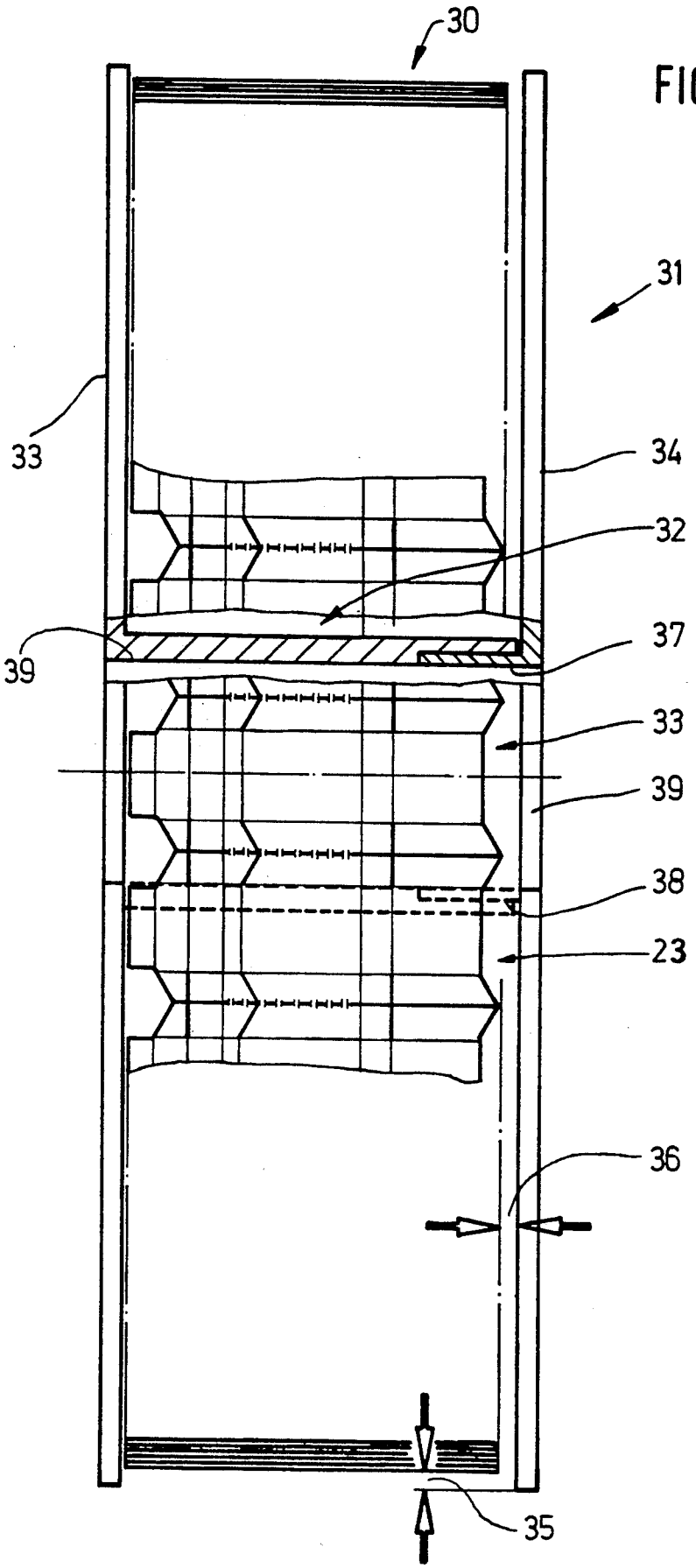
FIG. 3 shows, in a partially sectional side view, a drum for receiving a reel consisting of a web of material according to FIG. 2.

The web of material 24 designed according to FIG. 2 is preferably wound into a roll or reel 30. In this space-saving arrangement, the web of material 24 is easy to transport, store and handle in the packaging machine. The reel 30 is arranged on a drum 31 which, according to the exemplary embodiment of FIG. 3, consists of a drum core 32 and of lateral drum flanges 33 and 34. The latter protect the edges of the web of material 24 or reel 30 which are irregular as a result of punching. The drum flanges 33, 34 are dimensioned such that they project a sufficient distance 35 beyond the outer periphery of the reel 30. As a result, the filled drum 31 can be transported on the ground by means of rollers and can be stored standing on the drum flanges 33, 34.

The size of the drum core 32 in the axial direction is such that the reel 30 which, in the present example, is wound excentrically forms an effective gap 36 relative to the adjacent drum flange 34 on the side sensitive to mechanical loads as a result of the shape of the blanks 23, in particular at the free edges of the front wall 12 and of the outer side tabs 15 tapering to a point. This gap 36 prevents mechanical loads and therefore deformations of the blanks 23 as a result of pressure against the drum flange 34.

For better handling and also for fault-free production of the reel 30, at least one drum flange 34 is removable, that is to say that facing the front wall 12. For this purpose, the drum flange 34 is equipped with an insertion sleeve 37 which is arranged on the inside and which penetrates positively, but releasably into a correspondingly dimensioned annular recess 38 in the drum core 32. In this exemplary embodiment, the drum core 32 is-connected only to the opposite drum flange 33.

A central, continuous drum orifice 39 allows attachment onto a rotatable supporting journal 40 in the packaging machine.

Figure 4:
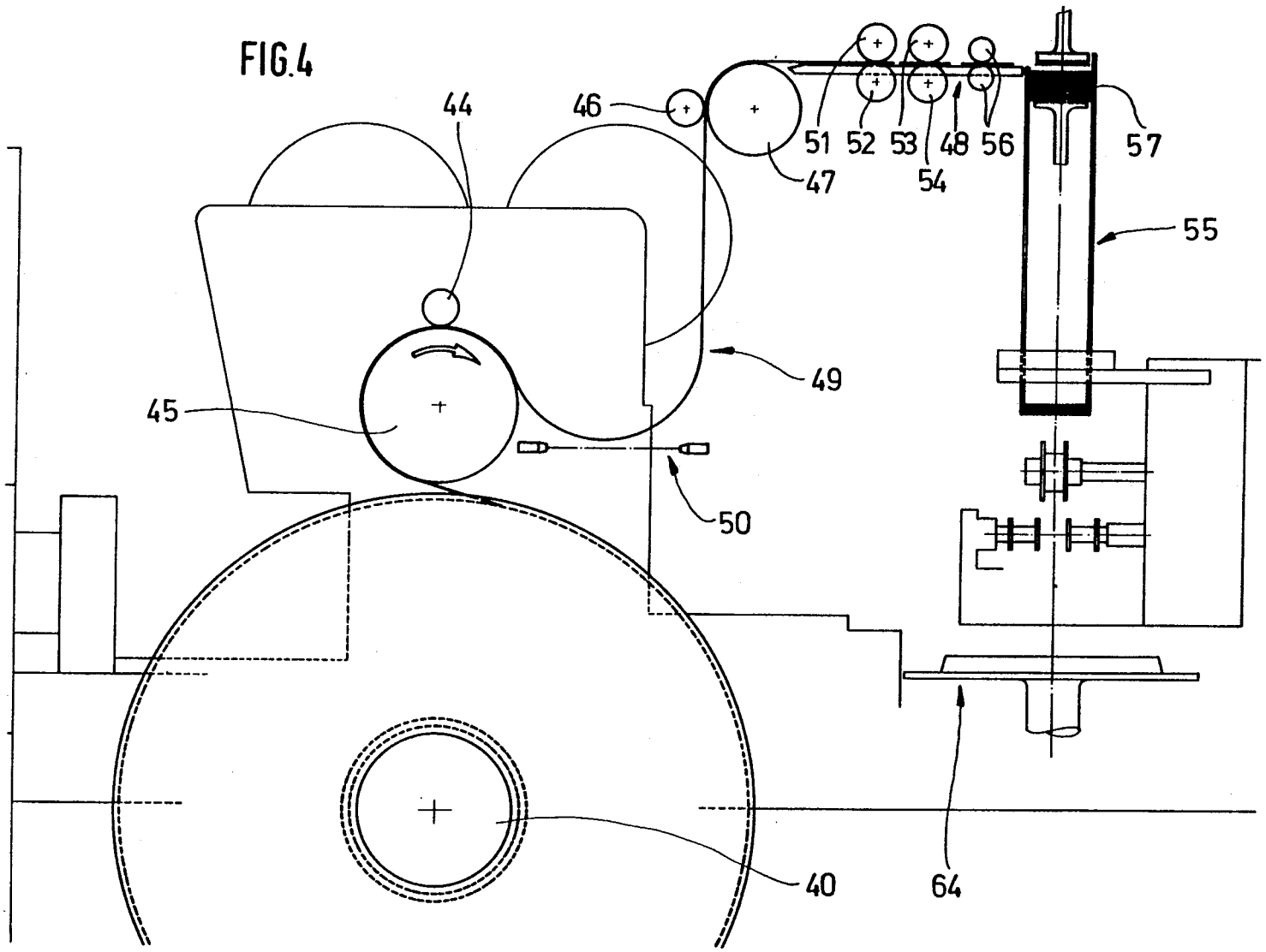
FIG. 4 shows a rear view of part of a packaging machine for the production of packs according to FIG. 1.
Figure 5:
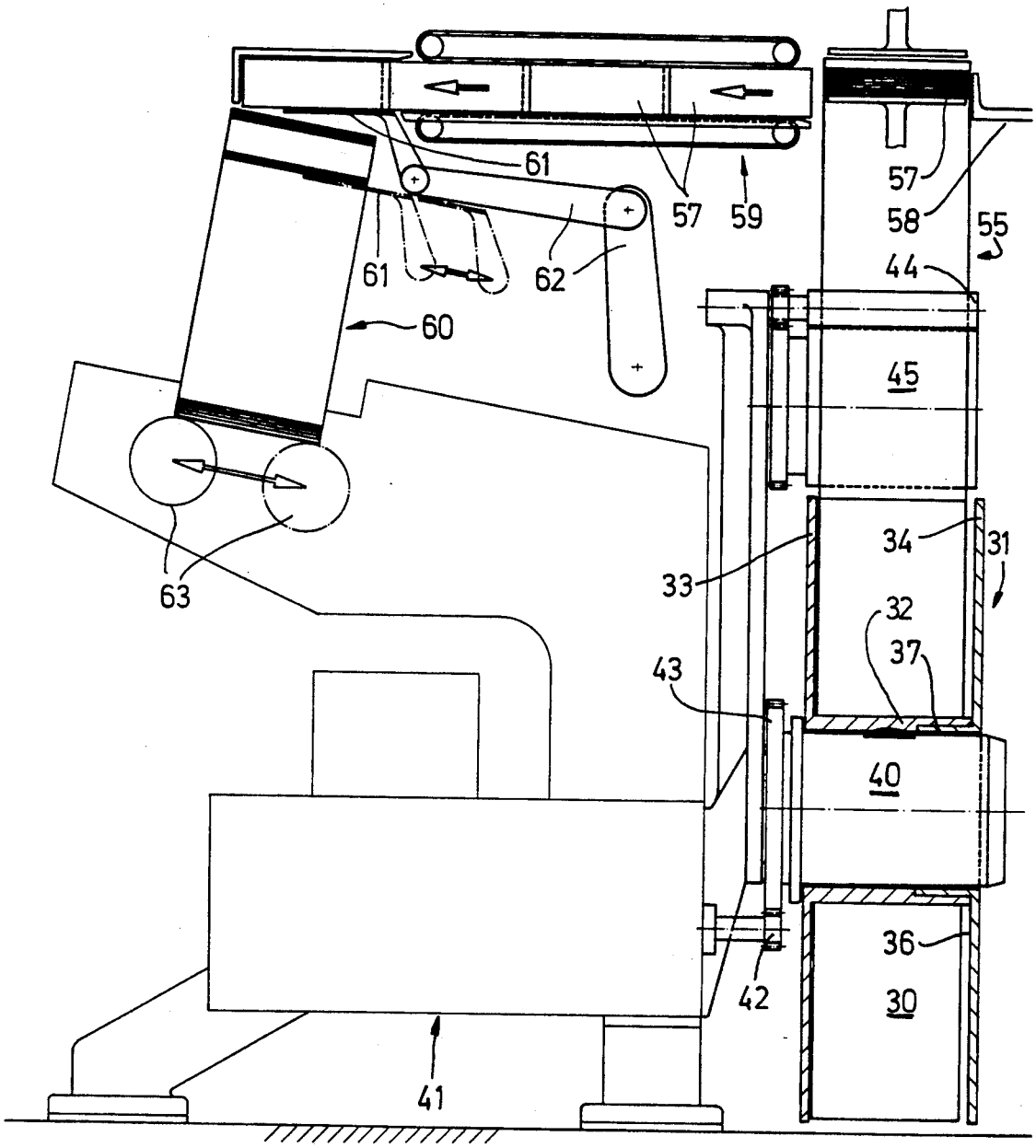
FIG. 5 shows, on an enlarged scale, the packaging machine and its details in a cross-section offset 90° relative to FIG. 4.

The blanks 23 of the present exemplary embodiment are processed in a packaging machine for the production of hinge-lid packs. FIGS. 4 and 5 show details, relevant in this connection, of a packaging machine of this type (known in principle).

The rearward pointing supporting journal 40 is mounted on the rear side of a machine stand 41, specifically at such a distance from the ground that a reel 30 or a drum 31 is held at a slight distance above the ground. The supporting journal 40 is driven rotatably, specifically by means of a motor via a pinion 42 and a gear wheel 43.

The web of material 24 is drawn off from the reel 30 or drum 31 by a first pair of drawing rollers 44, 45. The lower drawing roller 45 of larger diameter has at the same time a deflecting function. A second pair of drawing rollers 46, 47 is arranged at a distance above the drawing rollers 44, 45, and again the drawing roller 47 of larger diameter acts as a deflecting roller for conveying the web of material 24 into a horizontal conveyor track 48. A free sag 49 of the web of material 24 is formed as a small web reserve between the drawing rollers 44, 45 on the one hand and the drawing rollers 46, 47 on the other hand. The amount of sag 49 is monitored by a light barrier 50.

The blanks 23 are separated from the web of material 24 in the region of the horizontal conveyor track 48, specifically by tearing. For this purpose, two pairs of tearing rollers 51, 52 on the one hand and 53, 54 on the other hand are arranged at a distance from one another in the conveying direction. The distance between the tearing rollers 51, 52 on the one hand and the tearing rollers 53, 54 on the other hand is somewhat less than the width of a blank 23. The tearing rollers 53, 54 are driven at a higher speed than the tearing rollers 51, 52. The particular front blank 23 of the web of material 24 is thereby torn off from the latter.

In the present example, the severed blanks 23 are conveyed into a vertical blank shaft 55, specifically by means of conveyor rollers 56. Blank stacks 57 are extracted from the blank shaft 55 in succession and transferred by means of a slide 58 onto a cross-conveyor 59. This transports successive blank stacks 57 into a region located above a blank-magazine 60 of conventional design. The particular blank stack 57 arriving is introduced by means of a lowering platform 61 into the upper region of the blank-magazine 60 as a result of a downward movement. The lowering platform 61 is retracted transversely in the lower position (positions represented by dot-and-dash lines) and is then moved back into the upper receiving position for the next blank stack 57, specifically by means of appropriately driven links 62.

On the underside of the blank magazine 60, blanks are extracted in succession by means of a known rolling-off device 63 and are delivered via conveying members to a folding turret 64 shown diagrammatically in FIG. 4.

The processing of the blanks 23 within a packaging machine can also take place in another way.

We claim:

1. A continuous web of thin cardboard material having defined within said web a series of adjacent elongated, approximately rectangular packaging blanks for forming finished hinge-lid packs with folding tabs (16, 22) having side edges (29) which are located only inside of, and are concealed in, a finished hinge-lid pack, wherein:

the series of elongated, approximately rectangular adjacent blanks (23) actually form the web (24) of material;

the blanks (23) are connected to one another within said web (24) only via a plurality of residual connections (25), and are delimited from one another, while still in said web, by parallel punching cuts (27, 28), which extend transversely relative to said web (24), and by a plurality of punched portions (26) between the residual connections (25);

each of said blanks has, facing its two adjacent blanks (23), outer pack side tabs (15) and inner pack side tabs (16), and outer lid side tabs (21) and inner lid side tabs (22), which respectively form side walls and lid side walls of the finished hinge-lid pack; and said residual connections (25) and said punched portions (26) are located in said web (24) only between the adjacent inner pack side tabs (16) and between said adjacent inner lid side tabs (22), so that said residual connections are completely concealed in the finished hinge-lid pack by the overlapping of said inner pack side tabs (16) and said inner lid side tabs (22) by said outer pack side tabs (15) and said outer lid side tabs (21), respectively.

* * * * *